US005419050A

United States Patent [19]

Moore

[11] Patent Number: 5,419,050

[45] Date of Patent: May 30, 1995

[54] RANGE ADJUSTABLE LASER SIGHT FOR BOWS

[76] Inventor: Larry Moore, 211 Jennifer La., P.O. Box 70, Cottonwood, Ariz. 86326

[21] Appl. No.: 218,081

[22] Filed: Mar. 28, 1994

[51] Int. Cl.[6] ..... F41G 1/467

[52] U.S. Cl. ..... 33/241; 33/265; 33/DIG. 21; 124/87

[58] Field of Search ..... 33/265, 241, DIG. 21; 124/87

[56] References Cited

U.S. PATENT DOCUMENTS

| | | | |
|---|---|---|---|
| 3,487,548 | 1/1970 | Frydenlund | 33/265 |
| 4,109,390 | 8/1978 | Smith et al. | 33/265 |
| 4,418,479 | 12/1983 | Stanchnik | 33/265 |
| 4,497,116 | 5/1985 | Hawkins | 33/265 |
| 4,541,179 | 9/1985 | Closson | 33/265 |
| 4,616,623 | 10/1986 | Williams | 33/265 |
| 4,726,123 | 2/1988 | Keller | 33/265 |
| 4,939,863 | 7/1990 | Alexander et al. | 33/265 |
| 5,001,837 | 3/1991 | Bray | 33/265 |
| 5,359,780 | 11/1994 | Dallaire | 33/265 |

*Primary Examiner*—Thomas B. Will

[57] ABSTRACT

An adjustable laser beam sight comprises a supporting plate and first, second and third serially arranged and rotationally coupled levers mounted on the supporting plate by two pivots. The first pivot rotationally couples the first lever to the supporting plate and the second pivot rotationally couples the third lever to the supporting plate. A laser beam emitting device is attached to the first lever. Rotation of the third lever, acting through the second lever, imparts a change in direction of the first lever and the laser beam. A range scale with its reference center substantially at the second pivot is provided on the supporting plate. An indicator on the third lever moves across the range scale as the third lever is moved to adjust the aim of the laser beam, thereby indicating a range setting.

19 Claims, 5 Drawing Sheets

FIG. 1
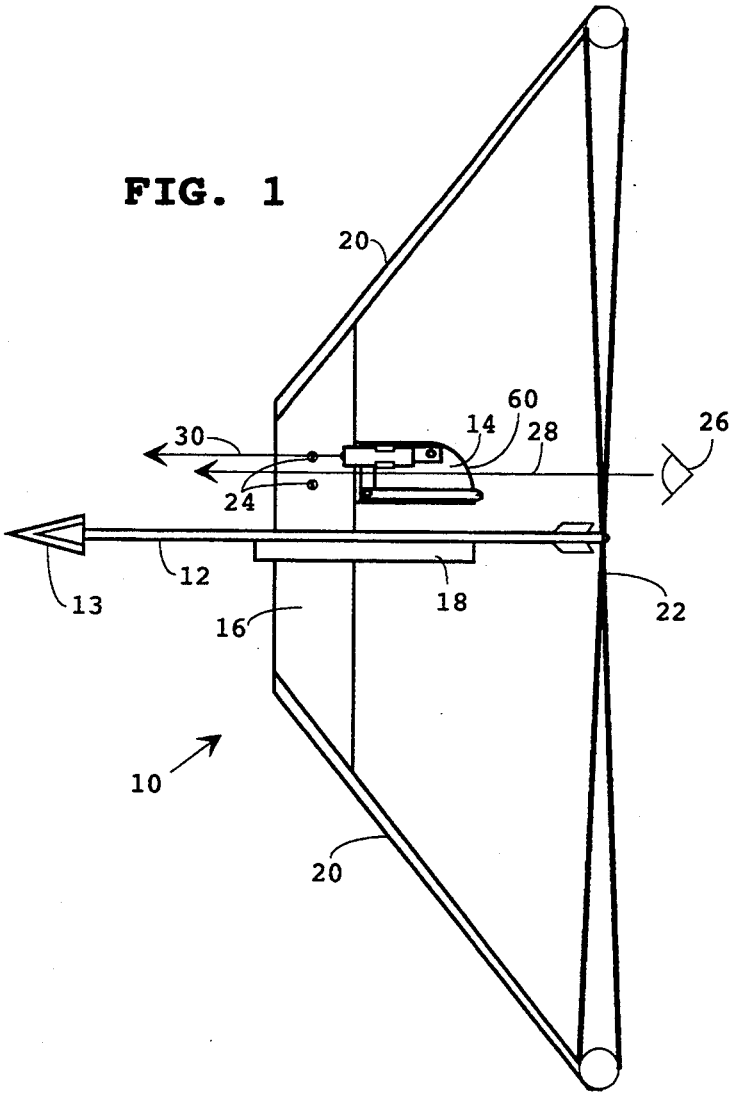
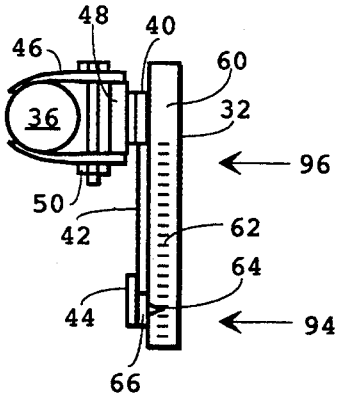
FIG. 3
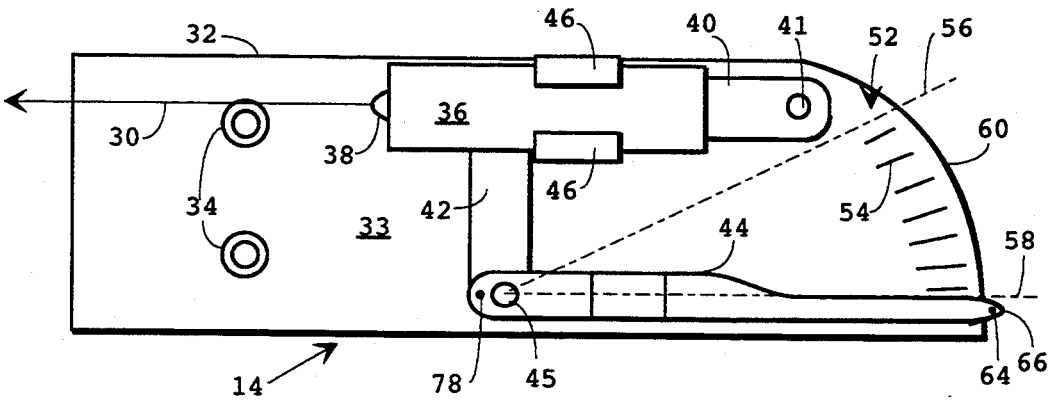
FIG. 2

RANGE ADJUSTABLE LASER SIGHT FOR BOWS

FIELD OF THE INVENTION

The present invention concerns an improved light beam sight adapted for use with bows and, more particularly, an improved range adjustable laser sight for bows.

BACKGROUND OF THE INVENTION

Modern bows are powerful weapons capable of launching an arrow with great force along a predictable trajectory having considerable range. Because of this there is a need for a sight which permits the user to accurately direct the arrow to the desired target. Sights similar to those used on firearms are sometimes employed. Because the manner of holding, drawing and aiming a bow and arrow is very different than the manner of holding and aiming a typical firearm, such prior art sights leave much to be desired when used on bows.

Laser and other light beam sights for firearms are well known, but they have been little used with bows because their mounting arrangements and range adjustment capabilities are ill suited to the needs of the bow user. For example, with most bows the trajectory of the arrow will drop much more than a bullet fired from most firearms. Thus, a convenient and quick means of range adjustment having the capability to accommodate large drops in the arrow trajectory is needed in connection with a bow mounted laser sight. Prior art laser sights intended primarily for use with firearms have not met these requirements. Further, the physical configuration of most bows is so different than most firearms that conventional firearm sight mounting arrangements are not suitable for use with bows. Accordingly, there is a continuing need for an improved light beam sight suitable for use with bows.

SUMMARY OF THE INVENTION

An advantage of the present invention is that it provides a light beam sight adapted to mount to a wide variety of modern bows and which provides quick and easy adjustment for ranges and trajectory drops of magnitudes characteristic of a bow and arrow. It may be used with many different types of bows, both hand and lever or winch cocked. It can easily accommodate the large drops typically encountered in the trajectory of arrows fired from a hand-drawn bow.

There is provided an adjustable light beam sight, comprising, a supporting plate and first, second and third serially arranged and rotationally coupled levers mounted on the supporting plate by two pivots, a first pivot rotationally coupling the first lever to the supporting plate and a second pivot rotationally coupling the third lever to the supporting plate, the second lever being allowed to rotate and translate with respect to the supporting plate in response to rotation of the first and third levers around, respectively, the first and second pivots, and a light beam emitting device coupled to the first lever so that motion of the third lever imparts a change in direction of the light beam.

In a preferred embodiment, there is further provided a range scale coupled to the supporting plate and having a center located substantially at the second pivot. The second lever is conveniently rotationally coupled to the first and third levers by, respectively, third and fourth pivots located near respective ends of the second lever. It is desirable that the second and fourth pivots be more closely spaced than the first and third pivots. Further, at least the second pivot desirably provides friction so that the levers remain in position after adjustment of the third lever until the third lever is moved again.

The present invention will be more fully understood by reference to the below listed drawings and the detailed description thereof and claims that follow.

BRIEF DESCRIPTION OF THE DRAWINGS

FIG. 1. is a side view of a hand-drawn bow with a light beam sight according to the present invention mounted thereon.

FIG. 2. is a side view of a light beam sight according to a first embodiment of the present invention and removed from the bow of FIG. 1.

FIG. 3 is an end view of the light beam sight of FIG. 2.

DETAILED DESCRIPTION OF THE DRAWINGS

Figure 4:
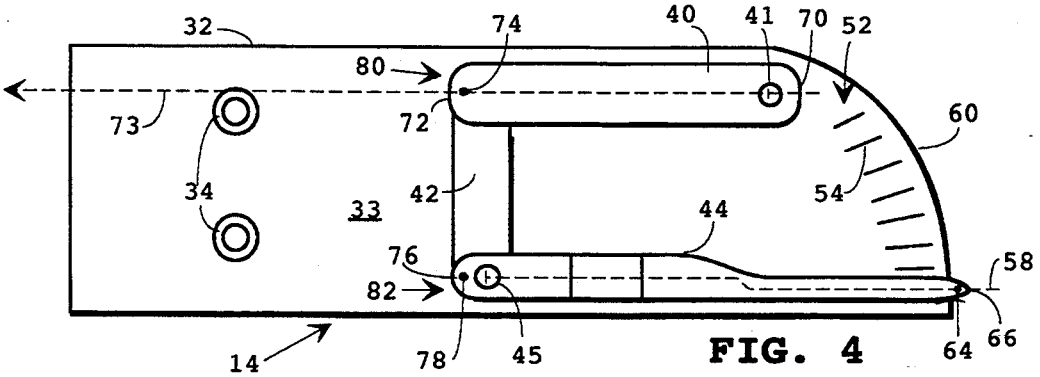
FIG. 4 is a side view of the light beam sight of FIG. 2 with the light beam generator removed.

FIG. 1. is a side view of handdrawn bow 10 with arrow 12 having head 13 and light beam sight 14 according to the present invention mounted thereon. Bow 10 and arrow 12 are conventional. Bow 10 includes hand-hold 16, arrow rest 18, bow limbs 20 and bow-string 22. Bow 10 illustrated in FIG. 1 is generally of the type referred to as a compound bow, that is, a bow utilizing a combination of pulleys and/or cams, for example, to provide sufficient mechanical advantage to allow an average user to bend very stiff bow limbs 20 and thereby propel arrow 12 with great force. Light beam sight 14 is conveniently mounted to hand-hold 16 by screws or bolts 24, but any convenient manner of attachment will serve.

User's eye 26 is placed behind bow-string 22 looking forward in direction 28 along which arrow 12 will generally travel when bow string 22 is released. Light beam sight 14 produces narrow light beam 30 pointed in the direction of travel of arrow 12. Light beam sight 14 produces a comparatively small diameter spot on the prospective target, e.g., in the range of 25–150 mm diameter at 100 meters, which the user takes advantage of in aiming the bow. Light beam 30 is arranged to lie in the plane formed by the trajectory of arrow 12 under ideal conditions. The light beam spot produced by sight 14 is placed by the user on the target. Assuming no wind or other side deflecting moments, the arrow will strike where the light beam spot is placed, provided that the fall of the arrow along its trajectory is properly taken into account. To do this, it is necessary to be able to easily change the vertical or up-down angle of light beam 30 relative to the unfired arrow. As used herein, the words "vertical" and "up-down" are intended to refer to directions substantially parallel to the local gravity vector.

FIG. 2 is a side view and FIG. 3 is an end view of light beam sight 14 of FIG. 1 in greater detail and removed from bow 10. Sight 14 comprises supporting plate 32 having major surface 33 and conveniently provided with bolt or screw holes 34 for mounting supporting plate 32 to bow hand-hold 16 by screws or bolts 24 as shown in FIG. 1. Sight 14 has light beam generating module 36, generally including lens or window 38 which collimate s light beam 30 into a narrow pencil of light. Light beam generating module 36 is desirably of the type employing light emitting diodes (LED's) or, as they are often referred to in the art, "laser diodes". One of the features of such diodes is that they are capable of producing a very narrow but intense beam of light. Suitable laser diode type light beam emitting modules are manufactured by Lyre Optronics, Santa Monica, Calif. As used herein, the word "laser" is intended to include any light source capable of producing a narrow light beam. However, laser diodes are preferred.

In the preferred embodiment, sight 14 further comprises three serially arranged and rotationally coupled levers 40, 42, 44. Levers 40 and 44 are further rotationally coupled to supporting plate 32 by pivots 41, 45, respectively. Light emitting module 36 is coupled to lever 40 by means of clamp 46 and, conveniently, mounting block 48 which is attached to lever 40. Bolt and nut 50 conveniently pinches together the arms of clamp 46 so that it tightly grasps the sidewall of generally cylindrical light beam module 36 and at the same time, grasps opposing surfaces of mounting block 48. However, any convenient means of attaching light beam emitting module 36 to lever 40 may also be used. Lever 40 is referred to herein as the light beam module supporting lever, lever 42 as the coupling lever and lever 44 as the control lever.

Range scale 52 comprising, for example, short segments of radial lines 54 passing through a substantially common center at the location of pivot 45 (as shown by extended dashed lines 56, 58) is conveniently provided on supporting plate 32. Movement of lever 44 around pivot 45 in a plane parallel to the plane of major surface 33 of supporting plate 32 causes lever 44 to intersect various ones 54 of range markers 52 according to its relative position. How this produces a change in the aiming point of light beam 30 from light emitting module 32 will be presently explained.

While range scale 52 may be placed on surface 33 of supporting plate 32, a more desirable arrangement is to provide rearward facing curved surface 60 which has a center of curvature substantially corresponding to the location of pivot 45. Surface 60 has thereon, range markers 62 and lever 44 has pointer 64 provided near end 66 of lever 44, for indicating various ones of range markers 62. In the same manner as described above, rotating lever 44 around pivot 45, causes pointer 64 to move across various ones of range markers 62, depending upon the angle to which lever 44 is set.

Figure 5:
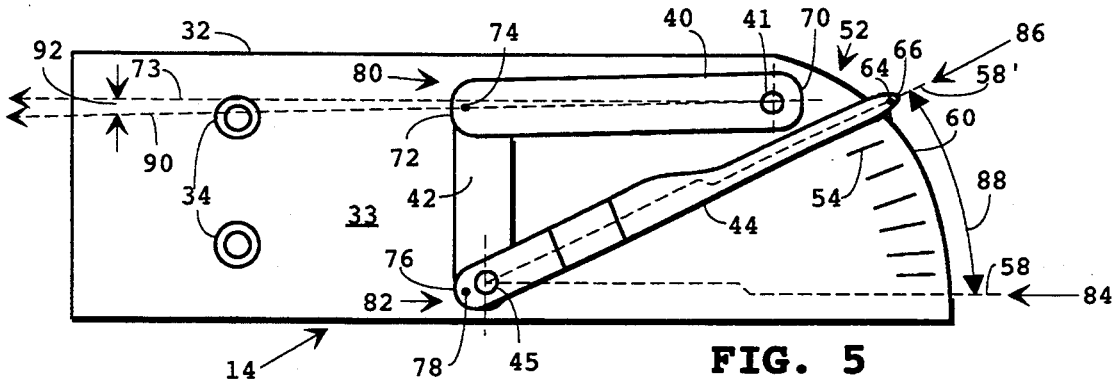
FIG. 5. is a view similar to FIG. 4 but showing how movement of the control lever changes the angular orientation of the light beam generator supporting lever.
Figure 6:
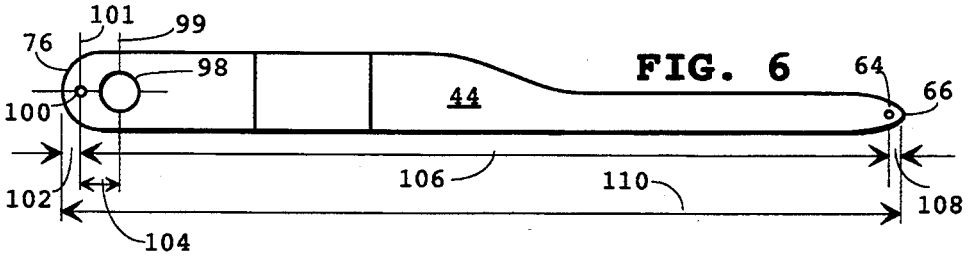
FIG. 6 is a side view
Figure 8:
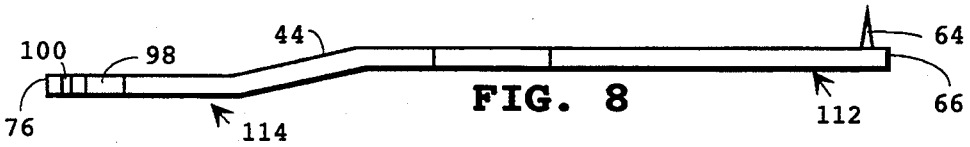
FIG. 7 is an end view and FIG. 8 is a top view of the control lever, according to a preferred embodiment and showing additional detail.
Figure 10:
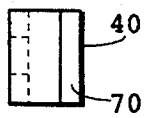
FIG. 10 is an end view and FIG. 11 is a top view of the light beam generator supporting lever, according to a preferred embodiment and showing additional detail.
Figure 7:
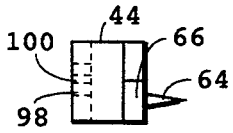
Figure 11:
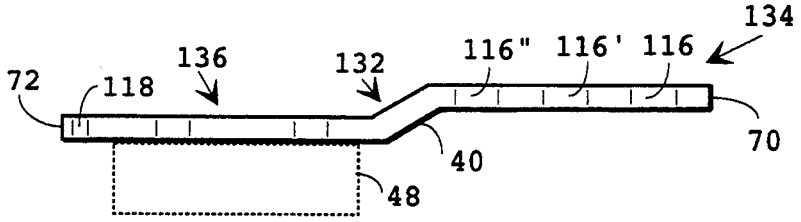
Figure 9:
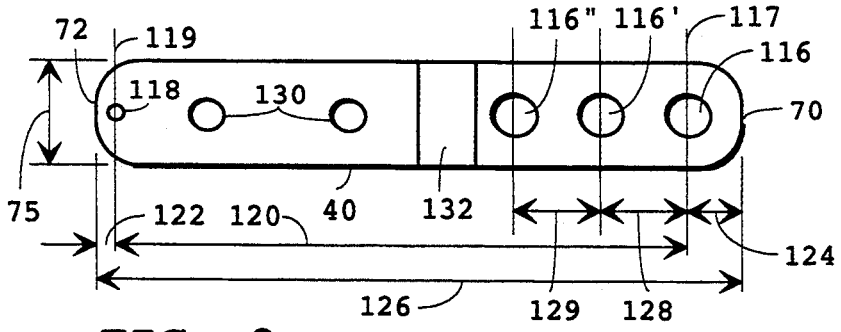
FIG. 9 is a side view
Figure 12:
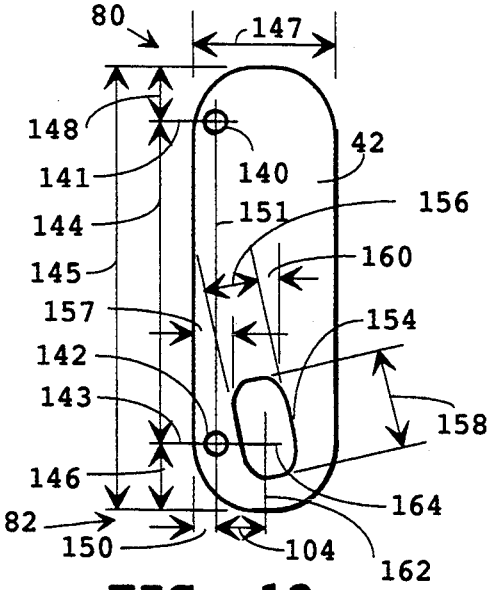
FIG. 12 is a plan side and FIG. 13 is a right edge view of the coupling lever running between the control and light beam generator supporting lever, according to a preferred embodiment and showing additional detail.
Figure 13:
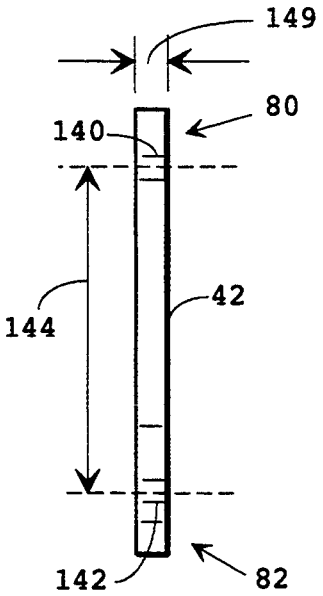

FIG. 4 is a side view of light beam sight 14 of FIG. 2 with light beam generator 36 removed and FIG. 5. is a view similar to FIG. 4 but showing how movement of control lever 44 changes the angular orientation of light beam 30 produced by light beam generator module 36 mounted on supporting lever 40. Pivot 41 rotationally couples light beam module supporting lever 40 to supporting plate 32 near end 70 of lever 40. Proximate ,opposed end 72 of lever 40 is another pivot 74 rotationally coupling lever 40 to lever 42. Control lever 44 has proximate end 76, additional pivot 78 coupling control lever 44 to lever 42. Pivots 74, 78 are located near ends 80, 82, respectively, of coupling lever 42: FIGS. 6–8 show control lever 44, FIGS. 9–11 show light emitting module mounting lever 40 and FIGS. 12–13 show coupling lever 42, all in greater detail. The preferred configurations of the three levers are more particularly illustrated in FIGS. 6–13.

Referring now to FIGS. 4–5, when control lever 44 is moved from its nominal "zero range" position 84 in FIG. 4 to non-zero range position 86 in FIG. 5 through arc 88, pointer 64 moves along range scale 62 (see FIG. 3) to indicate a particular non-zero range corresponding to position 86. As a consequence of the angular movement of end 66 of control lever 44 upward and to the left in FIG. 5 through arc 88 around pivot 45, there is a corresponding movement of pivot 78 located near end 76 of control lever 44 downward and to the fight in FIG. 5. The movement of lower pivot 78 between control lever 44 and coupling lever 42 in a downward direction in response to the counterclockwise rotation of control lever 44, causes upper pivot 74 between coupling lever 42 and mounting lever 40 to move in a downward (counterclockwise) direction, imparting a similar motion to end 72 of mounting lever 40. Since light beam emitting module mounting lever 40 is constrained to rotate around pivot 41, movement of control lever 44 through arc 88 and corresponding but smaller movement of coupling lever 42 through arc 92 causes mounting lever 40 to move from its initial angular position indicated by dashed line 73 to a new angular position indicated by dashed line 90. The angle of mounting lever 40 in the plane parallel to surface 33 of mounting plate 32 has changed by angle 92. When bow 10 is held in a normal upright position, this would also be the vertical direction.

Since light emitting module 36 is coupled to lever 40, the light beam 30 moves from direction 73 to direction 90. The farther the arrow must travel the larger the depression (downward) angle that must be imparted to mounting lever 40, and therefore to light beam 30 from module 36, and hence the larger the angle 88 through which control lever 44 must be moved. Range marker 94 depicted in FIG. 3 at or near the bottom of range scale 62 indicates a short range setting and range marker 96 at or near the top of range scale 62 indicates a long range setting.

The actual distance to which the various range markers correspond depends upon the arrow trajectory which in turn generally depends upon the particular bow and arrow combination being used and the amount of bow-string pull being provided by the user. However, such distances may be readily determined by repeatedly firing an arrow using a standard bow-string pull into a known target at different distances. This allows the standard arrow trajectory to be measured, the drops determined for different distances and the range markers on either of range scales 52, 56 correlated with those distances and drops. Persons of skill in the art of using a bow and arrow understand how to calibrate an adjustable sight in this manner.

FIGS. 6–8 show, respectively, a side view, end view and top view of control lever 44 according to the preferred embodiment of the present invention and in greater detail. Control lever 44 has near end 76, hole 98 to accommodate pivot 45 having center line 99 and, still closer to end 76, hole 100 to accommodate pivot 78 having centerline 101. Hole 100 for pivot 78 is separated from end 76 of lever 44 by distance 102 sufficient to provide enough material of lever 44 so that pivot 78 is retained in lever 44 without distortion or failure. Pivot 78 and corresponding hole 100 are separated from hole 98 and pivot 45 by distance 104. Distance 104 is much less than distance 106 between hole 100 and indicator 64. Indicator 64 is separated from end 66 of lever 44 by small distance 108 sufficient to provide enough material of lever 44 so that indicator 64 is retained in lever 44 without distortion or failure. Distance 104 is also much less than distance 110 between ends 66, 76 of lever 44. As indicated in FIG. 8, lever 44 desirably has an off-set to allow portion 112 to lie substantially flat against surface 33 of supporting plate 32 while portion 114 is spaced from surface 33 by approximately thickness 149 of coupling lever 42. This is desirable because it reduces the likelihood that lever 44 will be inadvertently bumped or become snagged in the user's clothing or on branches or other natural obstacles, thereby disturbing the setting of lever 44, but this is not essential.

FIG. 9 is a side view, FIG. 10 is an end view and FIG. 11 is a top view of light emitting module mounting lever 40, according to a preferred embodiment of the present invention and showing greater detail. Lever 40 has near end 70, hole 116 with centerline 117 for receiving pivot 41 and hole 118 having centerline 119 proximate opposed end 72 for receiving pivot 74. Centerlines 117 of hole 118 and centerline 117 of hole 116 are spaced distance 120 apart. Distance 120 is the distance separating the centerlines of pivots 41 and 74 when levers 40, 42 are assembled on supporting plate 32. Hole 118 is located at distance 122 from end 72 and hole 116 is located at distance 124 from end 70 of lever 40, i.e., centerlines to ends. Distance 122 and 124 need only be sufficient to provide adequate strength of the material of lever 40 so that holes 118, 116 and pivots 41 and 74 do not move or become distorted or damaged during routine use of the sight. Thus, distance 120 is conveniently only slightly shorter than distance 126 between ends 70, 72. Other then the desire to have sufficient mechanical strength in the material surrounding holes 116, 118 and the desire to have a compact sight, the exact length of lever 40 beyond holes 116, 118 is not especially important. Distance 120 between holes 118, 116 (or 118, 116', or 118, 116'') is important since it determines in part the deflection of light beam 30 in response to a predetermined movement of control lever 40.

For purposes of user selectable adjustment, optional holes 116' and 116' analogous to hole 116 are provided spaced at smaller distances from hole 118. Distance 120 is reduce by amount 128 for hole 116' and by distance 128 plus distance 129 for hole 116''. This allows the user to change the pivot to pivot spacing of pivots 41 and 74, thereby allowing the user to select different arrow drop adjustment ranges for sight 14. This a feature of the present invention.

Lever 40 conveniently has holes 130 for attaching mounting block 48 (see FIG. 3) that receives light emitting module clamp 46, however any means of providing mounting block 48, including having it as an integral part of lever 40, is also suitable. Lever 40 conveniently has offset 132 so that portion 134 of lever 40 can rest substantially in contact with surface 33 (see FIG. 2) while portion 136 of lever 40 is spaced away from surface 33 by a distance sufficient to accommodate thickness 149 of lever 42.

With respect to levers 40 and 44, it is desirable that they be spaced a small clearance distance away from surface 33 so that they can rotate around pivots 41, 45 without dragging on surface 33. This is readily accomplished, for example, by providing small spacers (see FIG. 15) between levers 40, 44 and surface 33 at pivot locations 41, 45. The offsets in levers 40, 44 allow lever 42 to rest substantially in contact with or in close proximity to surface 33. Again, a small clearance separation is desirable so that lever 42 does not drag appreciably on surface 33. Lever 42 is not attached to supporting plate 32 but, as has been previously explained, is coupled by pivots 74, 78 to levers 40, 44, respectively.

FIG. 12 is a plan side view and FIG. 13 is a fight edge view of coupling lever 42, according to a preferred embodiment of the present invention and showing greater detail. Lever 42 conveniently has length 145, width 147 and thickness 149. Lever 42 has hole 140 with centerlines 141, 15 1 for receiving pivot 74, located generally near end 80, and hole 142 with centerline 143, 151 for receiving pivot 78, located generally near end 82. Holes 140 and 142 (and therefore pivots 74 and 78) are spaced apart by distance 144. Holes 140, 142 are located with respect to ends 80, 82 such that there is sufficient strength of the intervening material of lever 42 so that holes 140, 142 (and pivots 74, 78 therein) do not distort or fail under reasonable use. Once this need is satisfied, distances 146, 148, 150 separating the centerlines of holes 140, 142 from the edges of lever 42 may be chosen for convenience of construction and assembly of laser sight 14 and for economy. Holes 140, 142 conveniently have common centerline 151.

In the embodiment shown in FIG. 12, lever 42 desirably has hole 154 of width 156 and length 158 spaced a distance 157 from the left edge of lever 42. Hole 154 is inclined at angle 160 with respect to center line 151. The intersection of centerlines 162, 164 indicate the location of the center of pivot 45 when levers 42 and 44 are assembled in the reference position (e.g., see FIG. 4). Hole 154 is provided so that as lever 44 is rotated counterclockwise from its reference position and lever 42 moves downward and to the right relative to supporting plate 32 in response to the movement of lever 44, pivot 45 being fixed to supporting plate 32, moves upward and to the left relative to lever 42 in hole 154. The size, shape and orientation of hole 154 merely need to be sufficient to allow such relative movement of pivot 45 and lever 42. This arrangement of having lever 42 captured around pivot 45 passing through hole 145 between lever 44 and surface 33 adds strength and shock resistance to the entire assembly and is preferred, but not essential.

Figure 14:
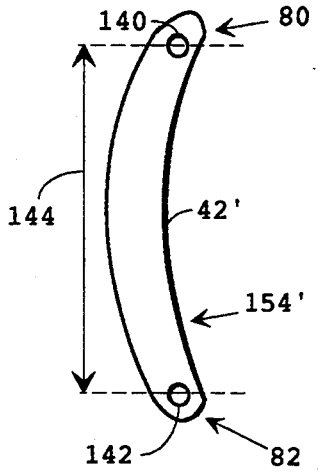
FIG. 14 is a view similar to FIG. 12, but of an alternate embodiment of the coupling lever.

FIG. 14 shows an alternative embodiment of lever 42' analogous to lever 42. Lever 42' has hole 140 for pivot 74 and hole 142 for pivot 78, wherein holes 140 and 142 are separated by center to center distance 144, analogous to the similarly identified holes and distances in lever 42. Rather than having hole 154, lever 42' has recess or indentation 154' which allows for relative movement of pivot 45 and lever 42' in the same manner as for hole 154 of lever 42. Those of skill in the art will understand that the exact shape of levers 42, 42' between holes 140, 142 is not important provided that they maintain the centerlines of pivots 74, 78 separated by distance 144 and that there is clearance space 154, 154' or equivalent to accommodate relative motion of lever 42, 42' and pivot 45 in response to movement of control lever 44.

Figure 15:
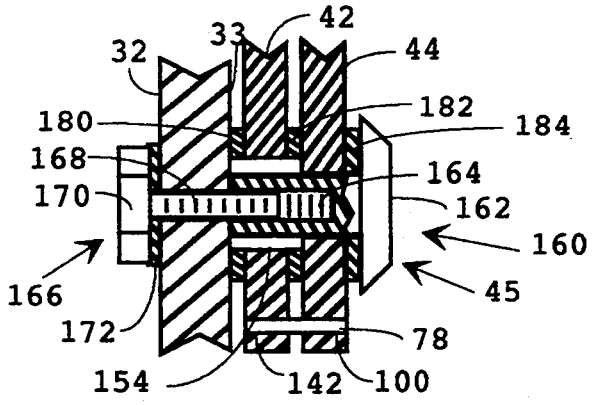
FIG. 15 is a partial cross-sectional and cut-away view of a typical arrangement of pivots.

FIG. 15 shows a simplified partial cross-sectional view at the location pivots 45 and 78 illustrating a suitable means of providing pivots 45, 78. A construction similar to pivot 45 is conveniently used for pivot 41. While the pivot construction illustrated in FIG. 15 is suitable, any of various means well known in the art for providing pivots at locations 41, 45, 74, 78 maybe used.

Pivot 45 conveniently comprises hollow threaded mandrel or nut 160 having head portion 162 and interior tapped tubular portion 164 which mates with bolt 166 having threaded shank 168 and head 170. Lock washer 172 may be provided under head 170, but any means of retaining bolt 166 and mandrel nut 160 at the desired degree of tightness may be used, as for example, provision of an epoxy or other plastic cement on mating threads 164, 168. This is desirable, since by proper adjustment of bolt 166 and mandrel nut 160, sufficient friction may be imparted to the rotation of lever 44 so that once lever 44 has been moved to a particular position by the user, it remains in that position until moved again by the user. For this reason, washer 172 may be of the Belville type to provide a controlled degree of tension for forcing supporting plate 32, lever 42 and lever 44 together. In order to provide for controlled spacing of lever 42 from surface 33 and between levers 42, 44 and between lever 44 and head portion 162, and to control the amount of friction therebetween, washers 180, 182, 184 are desirably provided but that is not essential. Delrin TM is a preferred material for some or all of washers 180, 182, 184 but any material having suitable frictional properties maybe used.

While in the arrangement shown in FIG. 15, pivot 45 is fixed on supporting plate 32 and lever 44 rotates around fixed pivot 45, this is not essential. Alternatively, pivot 45 may be fixed in lever 44 and rotate within a mating hole provided in supporting plate 32. Either arrangement is satisfactory.

Figure 16:
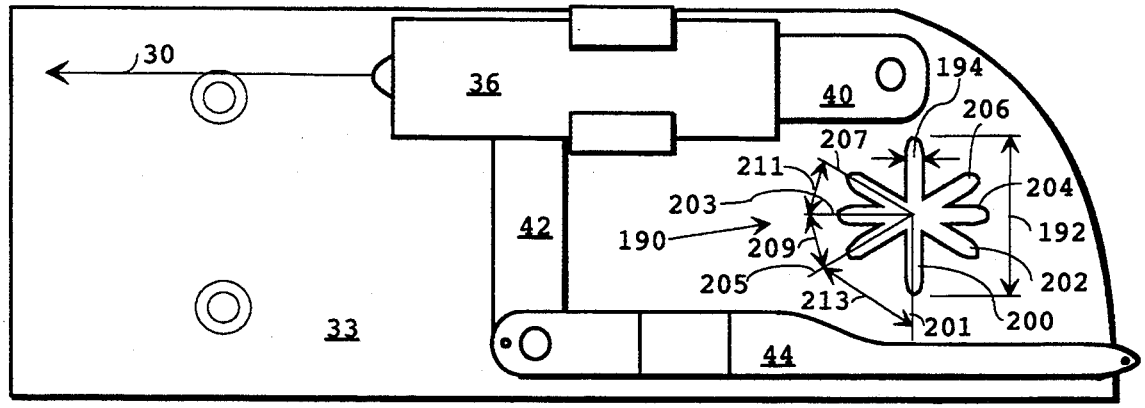
FIG. 16 is a view similar to FIG. 4 but showing additional features of the present invention.

FIG. 16 is a view similar to FIG. 4 but showing additional features of the present invention. There is conveniently provided in supporting plate 32, arrowhead tightening region 190 comprising, for example, one or more slots extending through supporting plate 32. The slots have length 192 and width 194 sufficient to accept arrowhead 13 or equivalent. It is desirable that multiple slots be provided intersecting substantially at the midpoints of their longitudinal dimensions, so that arrowheads having different numbers of blades may be accommodated. For example, arrowhead tightening region 190 is shown as having four slots 200, 202, 204 and 206 intersecting at their longitudinal midpoints. Slots 202 and 204 have their longitudinal centerlines 201,203 at right angles with respect to each other and slots 202 and 206 are oriented symmetrically about longitudinal centerline 203 of slot 204 with their longitudinal centerlines 205, 207 located at a predetermined angles 209, 211. Angles 209, 211 are conveniently in the range of about 30–45 degrees with about 30 degrees being preferred. Angle 213 is therefore conveniently ninety degrees less angle 209.

The arrangement depicted in FIG. 16 accommodates two, three, four and six bladed arrowheads. As referred to herein, a flat arrowhead with a blade extending symmetrically from each side of a central shaft is a two-bladed arrowhead, an arrowhead having a blade extending from each of three evenly spaced locations around the central arrow shaft (e.g., with blade edges which would intersect the vertices of an equilateral triangle), is a three-bladed arrowhead, and so forth. Many different arrowhead shapes can be accommodated by the arrowhead tightening region illustrated in FIG. 16. Incorporating the arrowhead tightening region in supporting plate 32 in a manner that does not interfere with the operation of sight 14 is a great convenience to the user since he or she need not carry a separate tightener since one is always built into the sight.

It is desirable that the distances between pivots be maintained within certain ranges. For example, distance 120 on light generator mounting lever 40 is desirably in the range of about 30–120 mm, more conveniently in the range 35–80 mm and preferable about 40–60 mm. Distance 144 on coupling lever 42 is desirably in the range of about 30–80 mm, more conveniently in the range 35–60 mm and preferable about 40–50 mm. Distance 144 on control lever 42 is desirably in the range of about 3–7 mm, more conveniently in the range 3.5–6 mm and preferable about 4–5 mm.

Stated alternatively, an upward rotation of lever 44 from reference position 84 through an arc of about 35 degrees, desirably produces a downward rotation of lever 40 and light beam 30 in the range of desirably 1.5 to 3.5 degrees, more conveniently about 2 to 3 degrees and preferably about 2.25 to 2.75 degrees with pivot 41 in hole 116. Relocation of pivot 41 causes the range of motion of lever 40 to change. For example, if the pivot to pivot distances are such that a 35 degree rotation of lever 44 produces a 2.5 degree rotation of lever 40 with pivot 41 placed in hole 116, then about 3.0 degrees is conveniently obtained with pivot 41 in hole 116' and about 3.5 degrees is conveniently obtained with pivot 41 in hole 116''. Stated another way, the spacing of holes 116, 116' and 116'' are desirably such that the ranges of rotation of lever 40 for the same rotation of lever 44 are in the ratio of 2.5:3.0:3.5, respectively, when pivot is located successively in holes 116, 116' and 116'', respectively.

A still further means of describing the present invention is through the interrelation between the pivot spacings expressed as a function of the spacing 104 between pivot 45 and pivot 78. For example, pivot-to-pivot spacing 144 in lever 42 is conveniently about 7–20 times spacing 104, more desirably about 8–14 times spacing 104, preferably in the range of about 9–12 times spacing 104 and more typically about 10–11 times spacing 104. Further, pivot-to-pivot spacing 120 in lever 40 is conveniently about 7–27 times spacing 104, more desirably about 8–20 times spacing 104, preferably in the range of about 9–14 times spacing 104 and more typically about 12–13 times spacing 104. Spacing 104 is generally less than 1/10th length 110, typically about 1/20th length 110.

EXAMPLE

The following is an example of a sight constructed according to the teachings of the present invention.

Plate 32 was formed from 3.2 mm thick steel or anodized aluminum and had an overall horizontal length of about 135 mm and a vertical height of about 64 mm.

Surface 60 had a radius of curvature of about 76 mm centered on the location of pivot 45. Pivots 41 and 45 were spaced vertically about 47.7 mm and horizontally about 51.6 mm (as used herein, "horizontal" and "vertical", "up", "down", "left" and "right" refer to the corresponding directions on FIGS. 2, 4–6, 9, 12 and 15). Pivot 45 was located about 76 mm from the lower right hand portion of plate 32.

Light beam generator mounting lever 40 had an overall horizontal length 126 of about 64.2 mm and vertical width 75 of about 13 mm and thickness of about 3.2 mm. The centers of the holes for pivots 41 and 74 lay along a common axis vertically centered on lever 42 and were spaced apart about 56 mm for hole 116, about 48.6 mm for hole 116' and about 41.2 mm for hole 116''. Hole 116 was about 4.7 mm in diameter and hole 118 was about 2.4 mm in diameter.

Coupling lever 40 corresponded to the embodiment depicted by way of example in FIGS. 12–13 and had an overall (vertical) length 145 of about 60.3 mm and (horizontal) width 147 of about 13 mm and a thickness 149 of about 3.2 mm. Pivot holes 140, 142 lay along a common axis 151 approximately parallel to the length of lever 42 (vertical direction in FIG. 12). Pivot holes 140, 142 were spaced apart by distance 144 of about 47.6 mm and had diameters of about 2.4 mm and were located laterally such that distance 150 in FIG. 12 was about 1.9 mm. Hole 154 had width 156 of about 5.1 mm and length 158 of about 7.9 mm and had its long axis inclined at about 10–15 degrees with respect to axis 151 of holes 140, 142. When lever 44 was in reference position 84 (see FIG. 5), pivot 45 passed through hole 154 without pivot 45 engaging the sides thereof, nor were the sides engaged as lever 44 was moved throughout its available arc. Control lever 44 corresponded to the configuration shown in FIGS. 6–8 and had an overall (horizontal) length 110 of about 86 mm, a (vertical) height of about 13 mm for the left portion 114 tapering to about a 3.2 mm radius at right end 66. Pivot hole 100 was spaced with distance 102 of about 1.9 mm from end 76 and the horizontal centerlines of pivot holes 98 and 100 were aligned along a common axis approximately vertically centered on lever 44 and their vertical centerlines 99, 101 were spaced apart by distance 104 of about 4.45 mm. Hole 100 was about 2.4 mm in diameter and hole 98 was about 4.7 mm in diameter. With levers 40, 42 and 44 coupled as described via pivots 74 and 78, and pivot 41 located in hole 116 and pivot 45 located in hole 98 and pivots 41 and 45 located as described on supporting plate 32, then rotation of lever 44 counterclockwise about pivot 45 by, for example, 35 degrees, caused lever 40 to rotate counterclockwise about pivot 41 by about 2.5 degrees. With lever 44 is reference position 84, arrowhead tightening region 190 could be easily accessed by arrowheads without interference from levers 40, 42, 44.

Those of skill in the art will understand that the dimensions given in this example are approximate and that, for example, holes 98, 100, 116, 118, 140, 142, etc., for accepting various pivots may, in levers 40, 42, 44 or plate 32, be made a little under or little oversized depending upon whether it is intended that the pivot be, for example, pressed fit into a particular lever or plate to be fixed and retained therein or whether it is intended to rotate on such pivot.

Having described the present invention those of skill in the art will understand that the present invention provides a light beam sight adapted to mount to a wide variety of modem bows and which permits quick and easy adjustment for ranges and trajectory drops of magnitudes characteristic of a bow and arrow. It may be used with many different types of bows, both hand and lever or winch cocked. It can easily accommodate the large drops typically encountered in the trajectory of arrows fired from a hand-drawn bow, and it conveniently incorporates an arrowhead tightener that does not interfere with the operation of the sight so that a separate tool is not required for that purpose.

While the present invention has been described in terms of particular embodiments, materials and examples, those of skill in the art will understand based on the description herein that other materials and components may be substituted for those described and alternate arrangements used without departing from the scope of the of the present invention and it is intended to include such substitutions, variations and alterations in the claims that follow.

I claim:

1. A light beam sight for bows, comprising:

a supporting plate;

a first arm having first and second opposed ends and rotationally coupled to the supporting plate by a first pivot located near the first end of the first arm and having a second pivot proximate the second end of the first arm;

a second arm having first and second opposed ends and rotationally coupled to the second pivot of the first arm at a first location proximate the first end of the second arm, and having a third pivot proximate the second end of the second arm;

a third arm having first and second opposed ends and rotationally coupled to the third pivot near the first end of the third arm and a fourth pivot for providing rotational coupling of the third arm to the supporting plate, the fourth pivot being located between the third pivot and the second end of the third arm; and a light emitting device coupled to the first arm for projecting a light beam toward a desired target, the direction of the light beam being adjusted by rotation of the third arm around the fourth pivot.

2. The sight of claim 1 further comprising a range scale on a surface of the supporting plate, wherein the range scale is located in relationship to the third arm so that rotation of the third arm indicates various ranges on the range scale.

3. The sight of claim 2 wherein the supporting plate has a peripheral surface facing away from the direction of the light beam, wherein the peripheral surface is curved in an arc having a center passing through the fourth pivot, and the range scale is located on the peripheral surface.

4. The sight of claim 3 further comprising an indicator means located proximate to the second end of the third arm and passing over the range scale located on the peripheral surface as the third arm is rotated about the fourth pivot, for indicating various markers on the range scale as the third arm is rotated and the light beam direction changed.

5. The sight of claim 1 wherein the light emitting device is an LED.

6. The sight of claim 1 wherein the third and fourth pivots are separated by a distance D and wherein the third and second pivots are separated by a distance in the range of 7 to 20 times D, and the second and first pivots are separated by a distance in the range of 7 to 27 times D.

7. The sight of claim 1 wherein rotation of third arm around the fourth pivot by about 35 degrees, produces a rotation of the first arm around the first pivot of about 2.5 to 3.5 degrees.

8. The sight of claim 1 wherein the second arm further comprises a clearance recess to permit the second arm to rotate and translate in response to the rotation of the third arm around the fourth pivot without the second arm contacting the fourth pivot.

9. The sight of claim 1 wherein the fourth pivot comprises a friction providing means to substantially hold the arms in a temporarily fixed relationship in the absence of intentional motion of the third arm.

10. The sight of claim 1 wherein the fourth pivot comprises self-releasing means for preventing free rotation of the arms in the absence of a force applied to the second end of the third arm.

11. A laser sight for bows, comprising:

a support means for coupling the laser sight to the bow;

first lever rotationally coupled near a first end by a first pivot to the support means and having near an opposed second end a second pivot;

second lever rotationally coupled near a first end to the first lever by the second pivot, and having near an opposed second end a third pivot;

third lever having a length L and rotationally coupled near a first end to the second lever by the third pivot and rotationally coupled to the support means by a fourth pivot, the third and fourth pivots being separated on the third lever by a distance D smaller than L; and a laser beam emitting device attached to the first lever.

12. The sight of claim 11 wherein D is less than 1/10th of L.

13. The sight of claim 11 wherein the first and second pivots are separated on the first lever by a distance X and the second and third pivots are separate on the second lever by a distance Y and wherein X takes on values from 7 to 27 times D, Y takes on values of 7 to 20 times D.

14. The sight of claim 11 wherein the support means comprises a curved surface region having a center of rotation located substantially at the fourth pivot, said curved surface region comprising range marks, each of said range marks corresponding to a predetermined drop of the laser beam below a reference location at a predetermined distance from the laser sight, and wherein movement of said third lever causes successive ones of the range markers to be indicated.

15. The sight of claim 14 wherein the curved surface region is located on a rearward facing surface of said support means visible to a user when the bow is in a position to fired.

16. An adjustable light beam sight, comprising, a supporting plate and first, second and third serially arranged and rotationally coupled levers mounted on the supporting plate by first and second pivots, the first pivot rotationally coupling the first lever to the supporting plate and the second pivot rotationally coupling the third lever to the supporting plate, the second lever being allowed to rotate and translate with respect to the support plate in response to rotation of the first and third levers around, respectively, the first and second pivots, a light beam emitting device coupled to the first lever so that motion of the third lever imparts a change in direction of the light beam, and a range scale coupled to the supporting plate and referenced substantially to the second pivot, wherein the second lever is rotationally coupled to the first and third levers by, respectively, third and fourth pivots located adjacent respective ends of the second lever.

17. The sight of claim 16 wherein the second and fourth pivots are more closely spaced than the first and third pivots.

18. The sight of claim 17 wherein the second and fourth pivots are spaced apart a distance D and the first and third pivots are spaced apart a distance X and X is at least about seven times D.

19. The sight of claim 18 wherein X is less than about twenty times D.

* * * * *